US007891033B2

(12) United States Patent
Loewenthal et al.

(10) Patent No.: US 7,891,033 B2
(45) Date of Patent: Feb. 22, 2011

(54) ADJUSTABLE SEAT CUSHION ASSEMBLY

(75) Inventors: Howard L. Loewenthal, Hinckley, OH (US); Daniel M. Hulse, North Olmsted, OH (US); Michael A. Babinec, North Olmsted, OH (US)

(73) Assignee: Invacare Corporation, Elyria, OH (US)

( * ) Notice: Subject to any disclaimer, the term of this patent is extended or adjusted under 35 U.S.C. 154(b) by 9 days.

(21) Appl. No.: 12/397,633

(22) Filed: Mar. 4, 2009

(65) Prior Publication Data

US 2009/0222992 A1 Sep. 10, 2009

Related U.S. Application Data

(60) Provisional application No. 61/033,706, filed on Mar. 4, 2008.

(51) Int. Cl.
*B68G 5/00* (2006.01)

(52) U.S. Cl. ..... 5/653; 5/648; 297/452.21

(58) Field of Classification Search ..... 5/653, 5/655, 657, 648; 297/452.31, 452.27, 452.21, 297/452.45, 452.25
See application file for complete search history.

(56) References Cited

U.S. PATENT DOCUMENTS 5,137,333 A * 8/1992 Chee ..... 297/452.21
5,378,045 A * 1/1995 Siekman et al. ..... 297/452.25
5,687,436 A * 11/1997 Denton ..... 5/653
7,040,706 B2 * 5/2006 Koffler ..... 297/452.25
7,373,678 B2 * 5/2008 Hetzel et al. ..... 5/653

* cited by examiner

*Primary Examiner*—Robert G Santos
*Assistant Examiner*—Brittany M Wilson
(74) *Attorney, Agent, or Firm*—Calfee, Halter & Griswold LLP

(57) ABSTRACT

According to one embodiment of the present invention, a seat cushion assembly is provided that includes a base cushion and a plurality of inserts. A recess is defined within the base cushion which is adapted to house the inserts. Each of the inserts can be selectively removed from the recess to provide for obliquity adjustment of the cushion assembly. In addition, the inserts may be selectively located on one side of the base cushion or the other to further adjust the inclined orientation of the base cushion. According to another embodiment, a seat cushion assembly is provided that includes a base cushion and a pair of inserts. A recess is defined within the base cushion which is adapted to house the inserts that includes a projection that has a plurality of surfaces that abut a surface of each of the inserts when the inserts are housed within the recess.

26 Claims, 7 Drawing Sheets

ADJUSTABLE SEAT CUSHION ASSEMBLY

PRIORITY CLAIM

This application claims priority from U.S. Provisional Patent Application Ser. No. 61/033,706 filed on Mar. 4, 2008 for ADJUSTABLE SEATING ASSEMBLY, the entire disclosure of which is fully incorporated herein by reference.

TECHNICAL FIELD

This detailed description relates generally to seating systems, and more particularly to adjustable seat cushion assemblies for wheelchairs, or other mobility aids.

BACKGROUND OF THE INVENTION

Wheelchairs are a means of transportation for a significant portion of society. Some wheelchairs include adjustable seating systems, such as for example adjustable seat cushion assemblies. The adjustability of such seating systems allow a user of the wheelchair or a therapist to adjust various aspects of the seating system in order to position or support the wheelchair user.

SUMMARY

This application relates generally to seating systems, and more particularly to seat cushion assemblies for wheelchairs, or other mobility aids, which can be customized to accommodate the needs of a user. Embodiments of seat cushion assemblies that permit customization to meet the needs of a user, such as the customization of the seat cushion assembly to accommodate or correct a patient's pelvic obliquity, are disclosed herein.

According to one embodiment of the present invention, a seat cushion assembly is provided that includes a base cushion and a plurality of inserts. A recess is defined within the base cushion which is adapted to receive or house the pair of inserts. When the inserts are both received or housed within the recess of the base cushion (i.e, in the default position or unadjusted position), the seat cushion assembly functions as a typical seating surface and neither side of the seat cushion assembly is raised higher than the other. Each of the inserts can be selectively removed from the recess of the base cushion to provide for obliquity adjustment of the seat cushion assembly. In addition, the inserts may be selectively located on one side of the base cushion or the other to further alter or adjust the inclined orientation of the base cushion.

According to another embodiment of the present invention, a seat cushion assembly is provided that includes a base cushion and a plurality of inserts. A recess is defined within the base cushion which is adapted to receive or house the inserts. The recess includes a projection that has a plurality of surfaces that abut a surface of each of the inserts when the inserts are housed within the recess.

BRIEF DESCRIPTION OF THE FIGURES

The drawings are only for the purpose of illustrating preferred embodiments and are not to be construed as limiting the invention.

DETAILED DESCRIPTION

Referring to the FIGURES, this detailed description discloses embodiments of seat cushion assemblies that permit customization to accommodate the needs of a user. Seat cushion assemblies may take a variety of different forms and may be used in a wide variety of different applications. This detailed description is applicable to seat cushion assemblies of varying construction. The scope of this application is intended to encompass all combinations and sub-combinations of the features of the seat cushion assemblies disclosed in this application.

Figure 1:
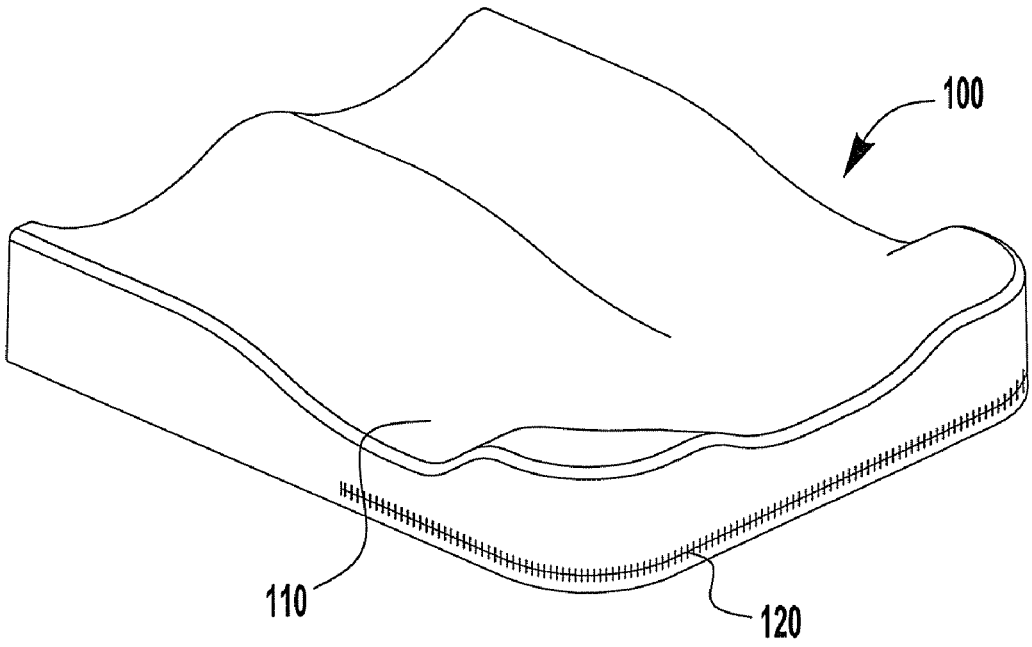
FIG. 1 is a top perspective view of a seat cushion assembly of an exemplary embodiment.

Referring to FIG. 1, a perspective view of an exemplary embodiment of a seat cushion assembly 100 is illustrated. The exemplary seat cushion assembly 100 includes an optional outer cover 110. The optional outer cover 110 can be made of any suitable material, for example, any type of cloth or fabric, vinyl, plastic, or other material. The optional outer cover 110 can take a wide variety of different shapes and configurations. The optional outer cover 110 can be made of a stretchable material that conforms to the shape of the other components of the seat cushion assembly 100. In addition, the optional outer cover 110 can be made from a moisture-resistant material that inhibits moisture from entering the seat cushion assembly 100 through the outer cover 110. The optional cover 110 illustrated in FIG. 1 includes an opening 120 to allow for the removal of the outer cover 110 or to allow for access to the other components of the seat cushion assembly 100. The opening 120 can be secured in a closed position by the use of a hook and loop type fastener, a zipper, buttons, snaps or any other fastening means.

In various embodiments, the seat cushion assembly 100 can include one or more optional moisture-resistant layers or wrappers (not shown), made from a polymer membrane or other moisture-resistant material, within the optional outer cover 110 to further inhibit liquid from seeping through the outer cover 110 to the other components of the seat cushion assembly 100.

Figure 2:
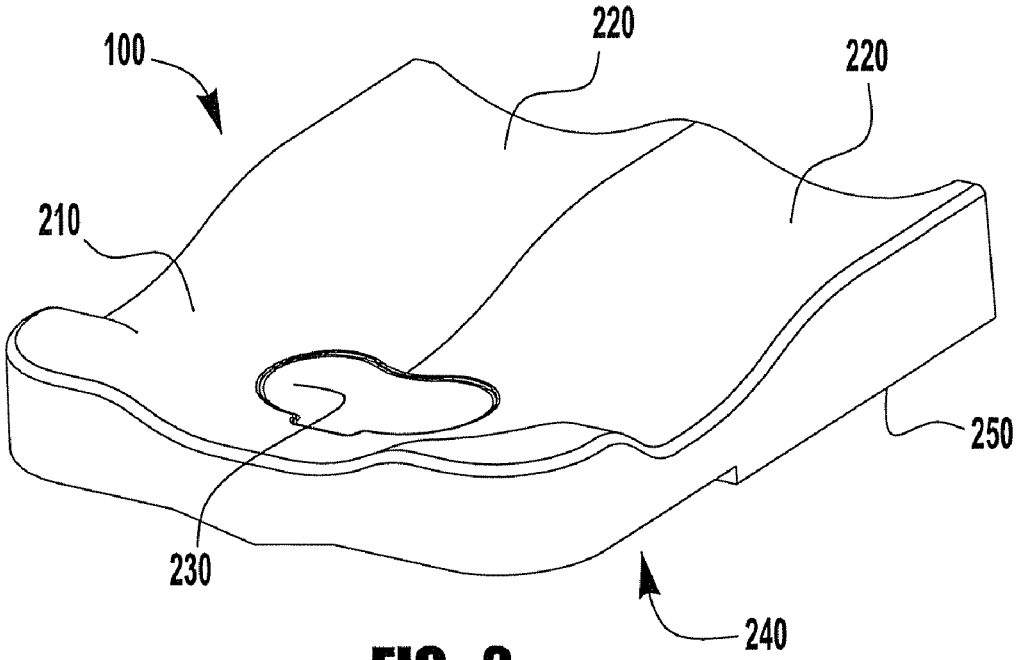
FIG. 2 is a top perspective view of the base cushion of the seat cushion assembly of FIG. 1.

Referring now to FIG. 2, the seat cushion assembly 100 is shown with the optional outer cover 110 removed. The exemplary seat cushion assembly 100 includes a base cushion 210. The base cushion 210 may be made from any suitable material, such as for example foam, rubber, plastic or combinations therof. Generally, the base cushion 210 is made from a material that is firm but compressible to provide adequate support for the user while still remaining comfortable. The base cushion 210 may have a variety of shapes and configurations. The base cushion 210 may be of unitary construction or may be constructed from multiple parts. As shown in FIG. 2, the exemplary base cushion 210 has a pair of channels 220 that are adapted to cradle the user's legs. The base cushion 210 also includes a rear depression 230 which is situated to accept a portion of the user's buttocks. The channels 220 and rear depression 230 may have a variety of shapes. It should be understood that additional embodiments of the base cushion are shaped and/or configured differently and do not include such channels 220 or a depression 230.

Figure 3:
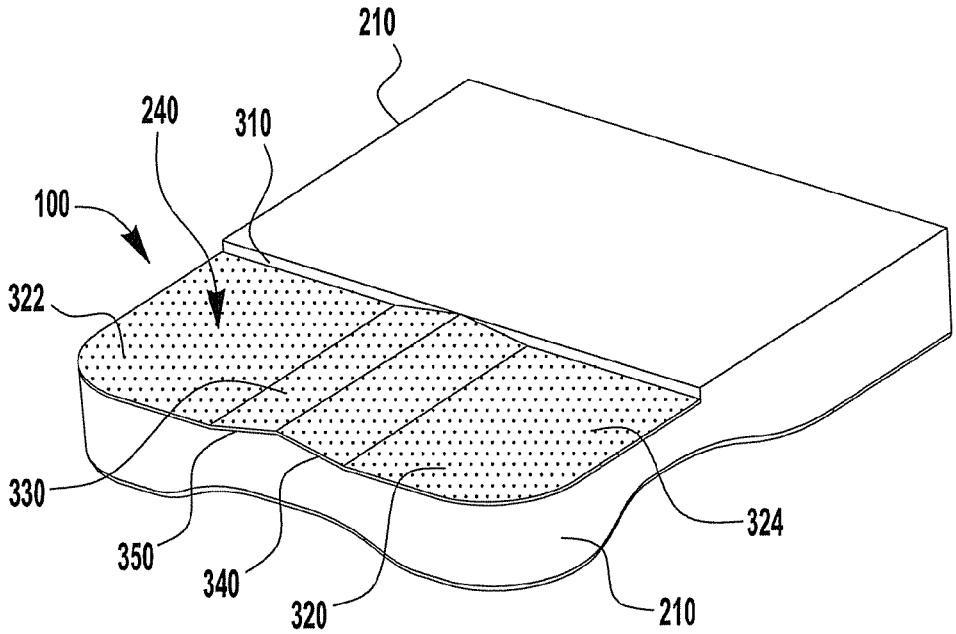
FIG. 3 is a bottom perspective of the base cushion of the seat cushion assembly of FIG. 1.

As shown in FIG. 2, a recess 240 is defined within a lower surface 250 of the exemplary base cushion 210. The recess 240 may have a variety of shapes and configurations. As shown in FIG. 3, the recess 240 of the illustrated embodiment of the base cushion 210 is a cut-away portion that spans the entire width of the base cushion 210 and a portion of the length of the base cushion 210. However, in additional embodiments of the seat cushion assembly 100, the recess 210 may span the entire length and width of the base cushion 210 and/or any portion of the length and width of the base cushion 210.

The recess 240 of the exemplary base cushion 210 includes an end wall 310 and a pair of insert receiving portions 320, 322 located on opposing sides of a projection 330. The exemplary projection 340 includes two inclined faces 340, 350. However, the projection 340 of additional embodiments of the seat cushion assembly 100 can be shaped and/or configured differently. For example, the projection may have a semi-circular or arcuate profile. In yet further additional embodiments, the seat cushion assembly 100 does not include a projection. The illustrated embodiment of the recess 240 includes an attachment element 324. The attachment element 324 of the illustrated embodiment is a layer of hook and loop fastener adherent material, such as felt or other suitable material. The attachment element 324 of additional embodiments of the recess 240 may be hook and loop fastener material located on the entire surface or a portion of the surface of the recess 240 or any other type of fastener or plurality of fasteners, such as for example tabs, snaps, hooks, straps, etc. Further embodiments of the recess 324 can be provided without an attachment element 324.

Figure 4A:
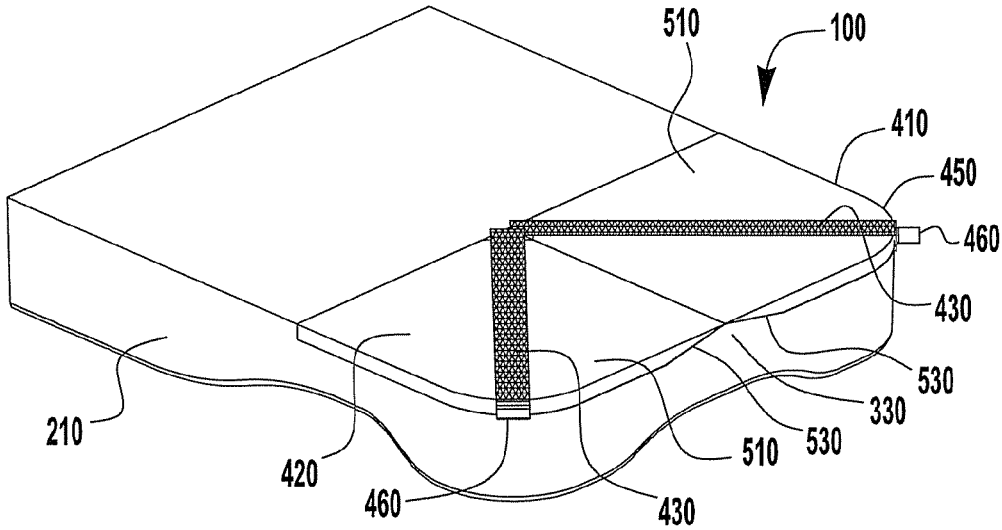
FIG. 4A is a bottom perspective view of the seat cushion assembly of FIG. 1 with the optional outer cover removed.
Figure 4B:
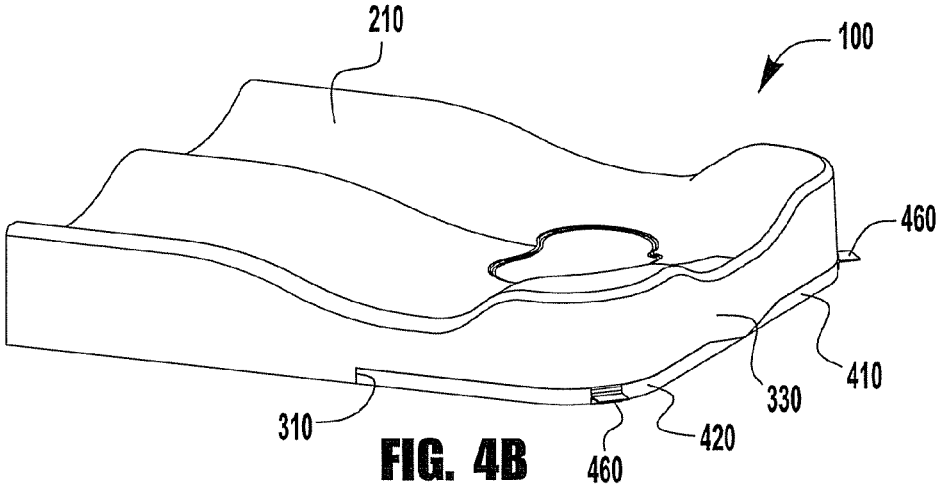
FIG. 4B is a top perspective view of the seat cushion assembly of FIG. 1 with the optional outer cover removed.

Referring now to FIGS. 4A and 4B, the insert receiving portions 320, 322 of the recess 240 are adapted to receive a plurality of inserts 410, 420. The inserts 410, 420 can have a variety of different shapes and configurations. As shown in more detail in FIG. 5, the inserts 410, 420 each have a generally flat bottom surface 510, a generally flat upper surface 520 and an inclined portion 530. However, the inserts 410, 420 can have a simple square shape or any other variety of shapes in alternate embodiments. The inserts 410, 420 of the illustrated embodiment are formed from foam, but any suitable material can be used, such as for example rubber or plastic. Additional embodiments of the seat cushion assembly 100 are not limited to a pair of inserts, as one insert or a variety of numbers of inserts can be provided. Additional embodiments of the seat cushion assembly 100 may be provided without a recess 240. In such embodiments, the inserts 410, 420 may be adapted to be attached or adhered to the base cushion 210 or located beneath the base cushion 210 without being housed within a recess.

Referring again to FIGS. 4A and 4B, the inserts 410, 420 are adapted to be housed within the recess 240 adjacent to one another, with each of the inserts 410, 420 abutting the projection 330 of the base cushion 210. However, in additional embodiments, the inserts 410, 420 may not be located adjacent to one another in this fashion. The inclined faces 340, 350 of the projection 330 are configured to abut against the inclined faces 530 of the inserts 410, 420. The complementary shapes of the inserts 410, 420, the insert receiving portions 320, 322 of the recess 240, and the projection 330 serve to locate the inserts 410, 420 relative to the base cushion 210 when the inserts 410, 420 are installed within the recess 240 (i.e., in the stored position). The contact between the end wall 310 of the recess 240 and the inserts 410, 420 inhibits the inserts from sliding beneath the base cushion 210. The contact between the projection 330 and the inserts hinders the inserts 410, 420 from moving or sliding relative to the width of the base cushion 210.

The exemplary seat cushion assembly 100 is configured in such a way that when the inserts 410, 420 are housed within the recess 240 of the base cushion 210, the lower surface 250 of the base cushion 210 and the bottom surfaces 510 of the inserts 410, 420 combine to form a level plane and allow the seat cushion assembly 100 to function as a typical seating surface. In the configuration of the seating assembly 100 illustrated in FIGS. 4A and 4B, neither side of the seating assembly 100 is raised higher than the other when the seating assembly 100 is resting on a flat surface.

Figure 5:
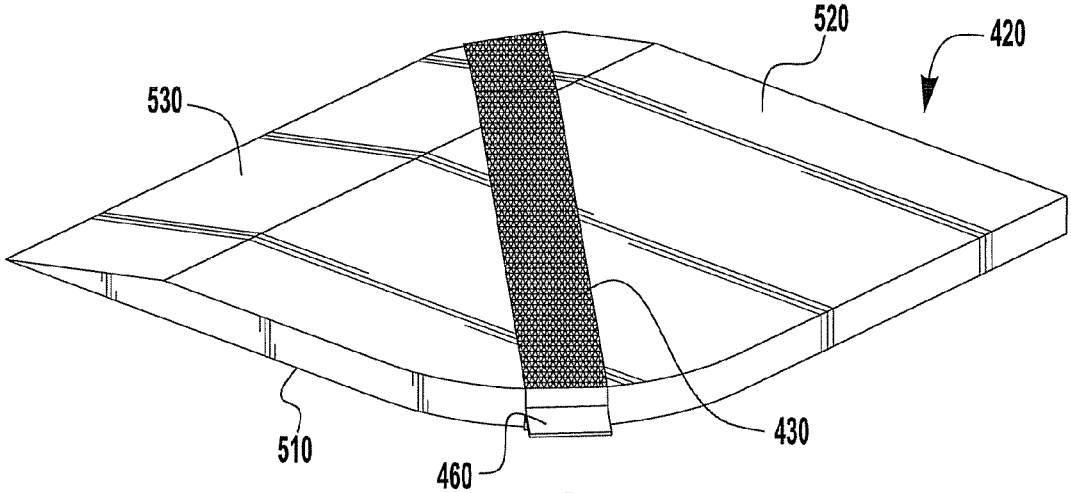
FIG. 5 is a perspective view of an insert of the seat cushion assembly of FIG. 1.
Figure 7:
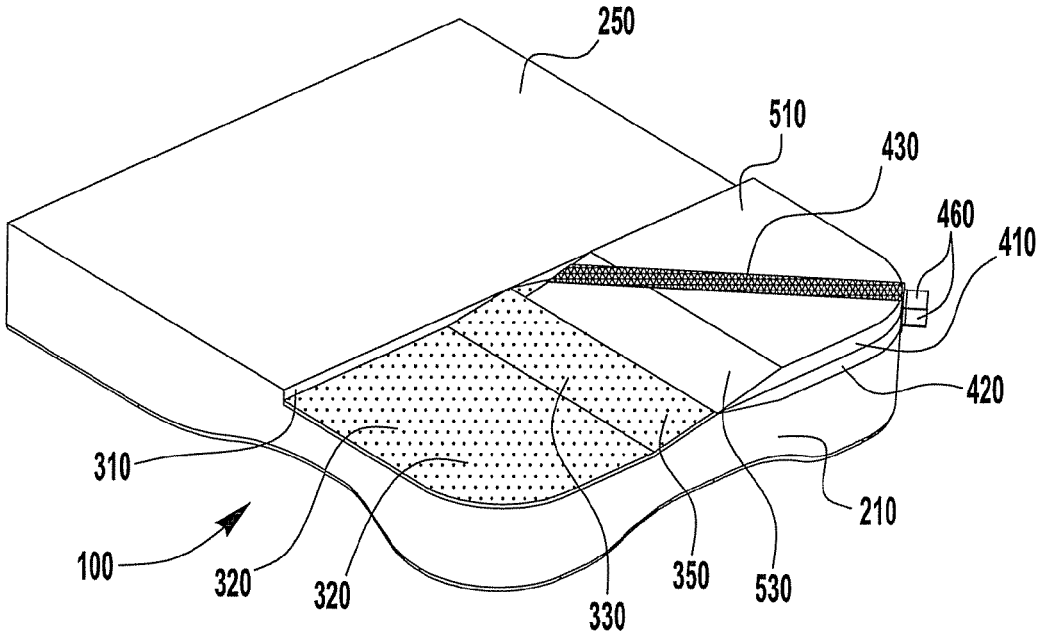
FIG. 7 is a bottom perspective view of the seat cushion assembly of FIG. 1 with the outer cover removed and both of the inserts located underneath one side of the base cushion.

As shown in FIG. 4A, the inserts 410, 420 include optional fasteners. The fasteners 430 of the exemplary inserts 410, 420 are hook and loop fastener strips that encircle the inserts 410, 420 so that a portion of the hook and loop fastener strip is located on the bottom surfaces 510 of the inserts 410, 420 (as shown in FIG. 4A) and a portion of the hook and loop fastener strip is located on the upper surfaces 520 (as shown in FIG. 5). The portions of the fasteners 430 that are located on the upper surfaces 520 of the inserts 410, 420 are adapted to selectively adhere to the hook and loop fastener adherent material of the attachment element 324 of the recess 240 to securely locate the inserts 410, 420 within the recess 240. The portions of the fasteners 430 that are located on the bottom surfaces 510 of the inserts 410, 420 are adapted to allow the inserts 410, 420 to be selectively attached to one another (as shown in FIG. 7). The fasteners 430 of the exemplary inserts 410, 420 comprise a hook and loop type fastener strip located on one insert that is loop material and a fastener strip on the other insert that is hook material. It should be understood, that fasteners other than hook and loop fasteners can be used in additional embodiments. The inserts 410, 420 include optional tabs 460 to facilitate the removal and/or positioning of the inserts.

Figure 6A:
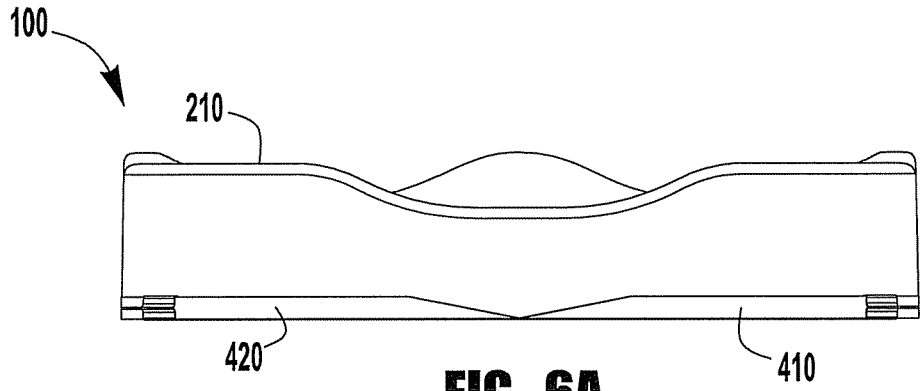
FIG. 6A is a rear view of the seat cushion assembly of FIG. 1 with the outer cover removed and both of the inserts in the stored position.

Referring now to FIG. 6A, when the inserts 410, 420 are both housed within the recess 240 beneath the base cushion 210 (i.e, in the default position or unadjusted position), the seat cushion assembly 100 functions as a typical seating surface. Neither side of the seat cushion assembly 100 is raised higher than the other.

Figure 6B:
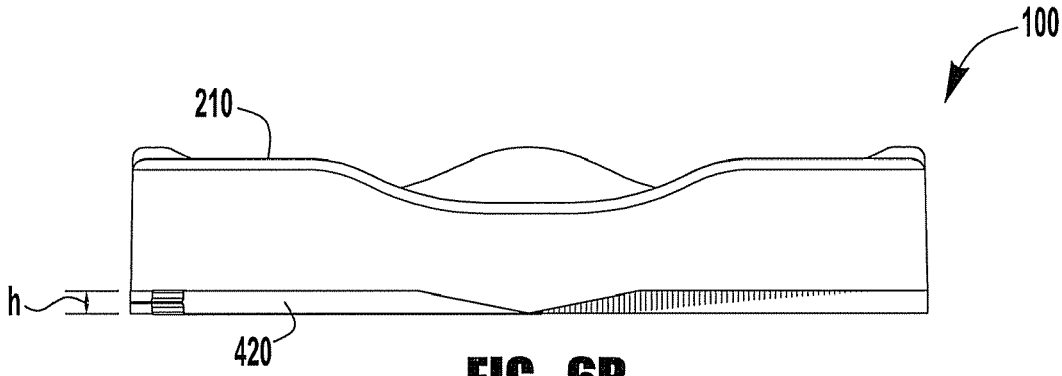
FIG. 6B is a rear view of the seat cushion assembly of FIG. 1 with the outer cover removed and one of the inserts in the stored position.

Both of the inserts 410, 420 can be selectively removed from the seat cushion assembly 100. The optional tabs 460 facilitate the removal of the inserts 410, 420. Referring to FIG. 6B, the exemplary seat cushion assembly 100 is shown with insert 420 in the recess 240 in the stored position and the other insert removed. The exemplary inserts 410, 412 have a height "h" which is approximately ½ inch, though that height can substantially vary (e.g., 0.25 to 1 inches or more). Additional embodiment of the seat cushion assembly 100 include inserts having a variety of heights. Furthermore, each insert need not be of the same height, shape, configuration as all of the other inserts.

Figure 6C:
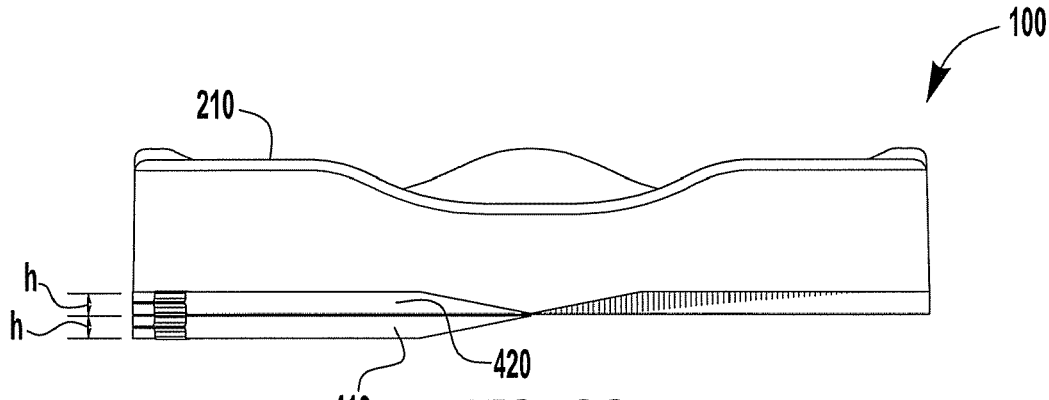
FIG. 6C is a rear view of the seat cushion assembly of FIG. 1 with the outer cover removed and with both of the inserts located underneath one side of the base cushion.

Referring now to FIG. 6C, the exemplary seat cushion assembly 100 is shown with insert 410 removed from the recess 240 and attached to insert 420. As shown in more detail in FIG. 7, the optional fasteners 430 of the inserts 410, 420 allow one of the inserts to be removed from the recess and attached to the other insert. In this configuration illustrated in FIG. 6C, the inserts 410, 420 located on one side of the base cushion 210 have a combined height of 2 h and no insert is located on the other side of the base cushion 210.

Figure 8A:
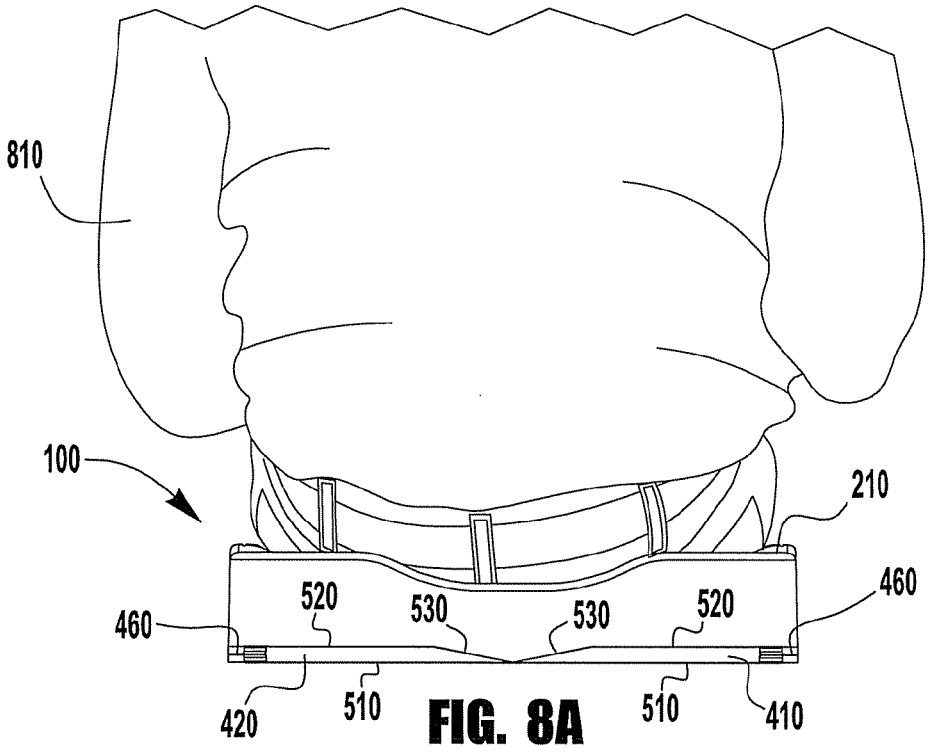
FIG. 8A is a rear view of a user seated in the seat cushion assembly of FIG. 1 with the outer cover removed and both of the inserts in the stored position.
Figure 8B:
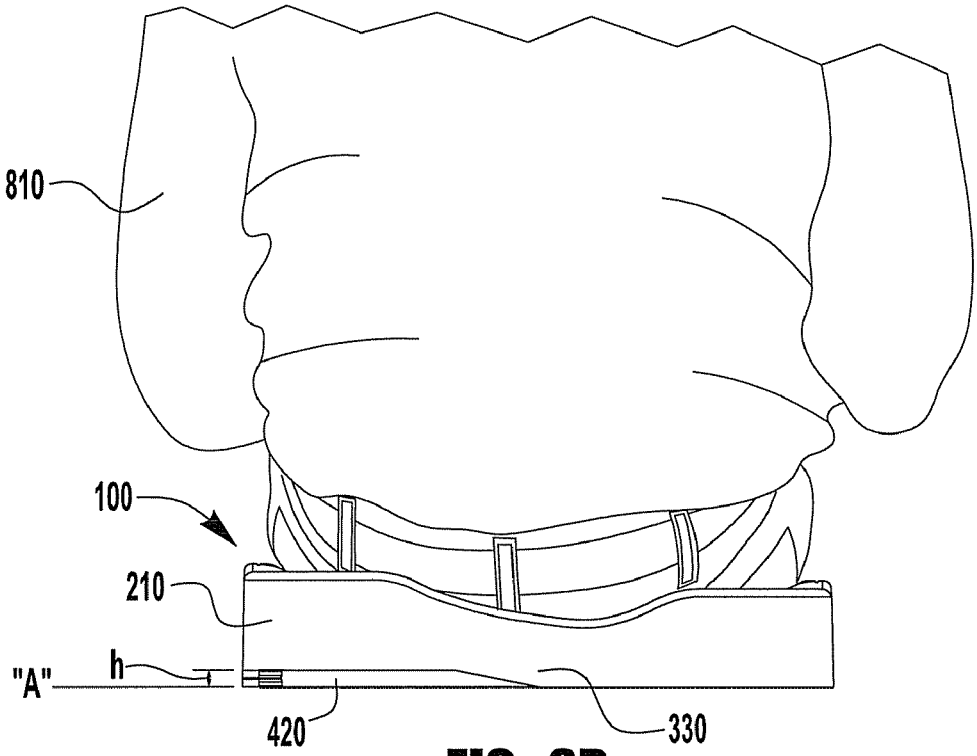
FIG. 8B is a rear view of a user seated in the seat cushion assembly of FIG. 1 with the outer cover removed and one of the inserts in the stored position.
Figure 8C:
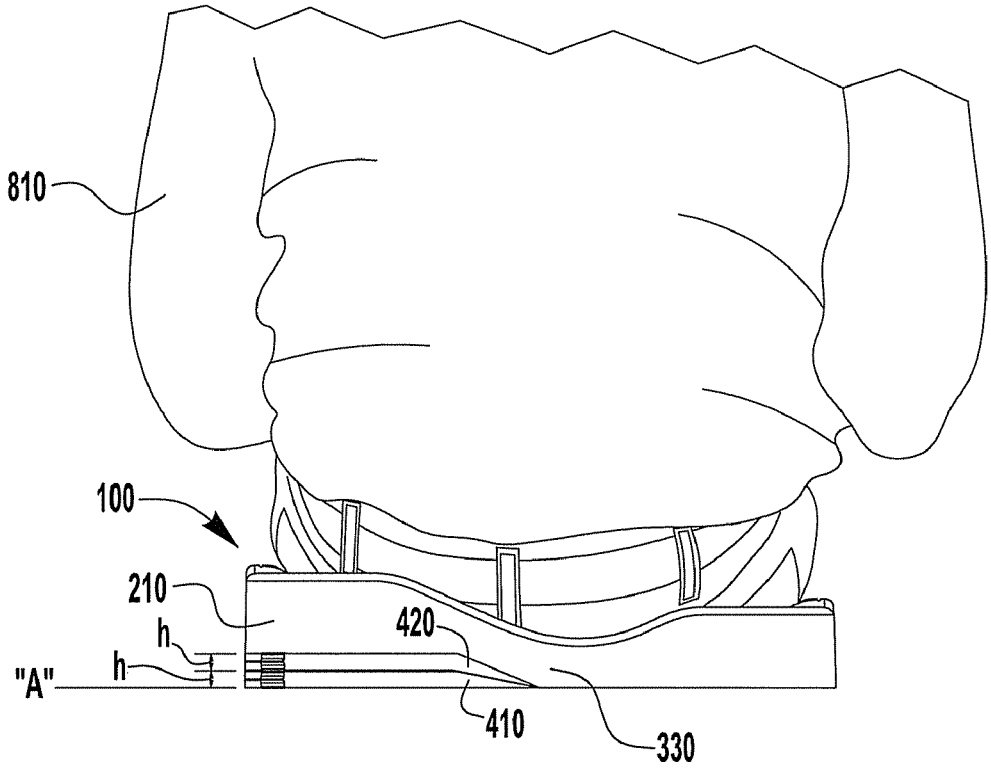
FIG. 8C is a rear view of a user seated in the seat cushion assembly of FIG. 1 with the outer cover removed and both of the inserts located underneath one side of the base cushion.

Referring now to FIGS. 8A-8C, a user 810 is shown seated in the exemplary seat cushion assembly 100. As illustrated in FIG. 8A, when the inserts 410, 420 are both housed within the recess 240 beneath the base cushion 210 (i.e, in the default position or unadjusted position), neither side of the seat cushion assembly 100 is raised higher than the other. In this configuration, the pelvis of the user 810 is maintained in a horizontal plane. This configuration of the seat cushion assembly 100 is used with a user who does not have a pelvic obliquity.

Referring now to FIG. 8B, the seat cushion assembly 100 is shown with insert 420 housed within the recess 240 and the other inset removed. As discussed previously, either of the inserts 410, 420 can be selectively removed from the seat cushion assembly 100. The removal of the insert from the right side of the seat cushion assembly 100, causes the weight of the user 810 to push the right side of the seat cushion assembly 100 down since the right side of the seat cushion assembly is no longer being supported by the removed insert. In this manner, the right side of the seat cushion assembly 100 is lowered relative to the left side of seat cushion assembly a distance approximately equal to the thickness h of the removed insert. Thus, the left side of the user's pelvis is raised (or the right side of the user's pelvis is lowered) by a distance h relative to a baseline "A". Conversely, the right side of the user's pelvis can be raised (or the left side lowered) by leaving insert 410 stored within the recess and removing insert 420 from the left side of the seat cushion assembly 100.

Referring now to FIG. 8C, the exemplary seat cushion assembly 100 is shown with insert 410 removed from the recess 240 and attached to insert 420. Due to the inclusion of both inserts 410, 420 on the left side of the seat cushion assembly 100, the left side of the seat cushion assembly is raised by a distance approximately equal to twice the thickness h of one of the inserts relative to baseline "A." Accordingly, the left side of the user's pelvis is raised (or the right side lowered) by this distance as well.

As shown in FIGS. 8B and 8C, when a user is seated in the seat cushion assembly 100 and one of the inserts 410, 420 is removed, the projection 330 of the base cushion, compresses and conforms to the contour of the surface supporting the seat cushion assembly 100. This characteristic of the projection 330 helps to ensure that the user will not perceive a bump or ridge caused by the transition between the boundaries of the housed insert(s) and the rest of the seat cushion assembly 100.

When diagnosing the pelvic obliquity of a patient, a clinician will observe the patient in a seated position and determine if one side of the patient's pelvis is higher than the other. Based upon the amount and type of pelvic obliquity exhibited by a particular patient, the clinician can determine whether to attempt to accommodate for or correct the patient's pelvic obliquity. The seat cushion assembly 100 of this detailed description affords a clinician the ability to customize the seat cushion assembly for use in either accommodating or correcting a pelvic obliquity.

To accommodate or correct a pelvic obliquity of a patient using the exemplary seat cushion assembly 100, a doctor, clinician, therapist or a wheelchair user opens the opening 120 of the outer cover 110 to access the inserts 410, 420. Using the optional tabs 460, one of the inserts 410, 420 may be removed from beneath the base cushion 210 as desired to make an obliquity adjustment (i.e., alter the angular orientation) of the seat cushion assembly 100. As described above, if desired, the removed insert may be repositioned beneath the remaining insert to further increase the distance that one side of the seat cushion assembly 100 is raised. In this manner, the seat cushion assembly 100 can be customized to raise or lower one side of a user's pelvis to accommodate or correct for a pelvic obliquity.

Because the inserts 410, 420 of the illustrated embodiment of the seat cushion assembly 100 are located beneath the base cushion 210 and not on top of it, the addition or removal of one or both of the inserts 410, 420 does not perceptively alter the upper contour (i.e., the shape of the seating surface) of the base cushion 210. The fact that the upper contour of the base cushion 210 is not altered contributes to the comfortability of the base cushion because the shape and contour of the seating surface is not altered at its interface with the user. In addition, due to the fact that the inserts 410, 420 of the illustrated embodiment are not directly adjacent to the user's buttocks (rather, the base cushion 210 is between the user and the inserts 410,410), the indentation load deflection (ILD) rating or deflection of the material chosen for the inserts may be harder without sacrificing comfort.

In additional embodiments of the seat cushion assembly 100, a system of inserts is provided that includes a plurality of inserts having different shapes, configurations and/or dimensions. This system of inserts is provided either in addition to inserts 410, 420 or as a replacement thereof. A user can select inserts of a desired shape, configuration, or dimension from the system of inserts to adjust the inclined orientation of the seat cushion assembly 100 a desired amount.

While the described embodiment of the seat cushion assembly 100 provides for the adjustment of the seat cushion assembly relative to the sagittal plane of a user seated within the seat cushion assembly, additional embodiments of the seat cushion assembly may provide for the alteration of the inclined orientation of the seat cushion assembly relative to the coronal plane and/or the sagittal plane of a user.

Figure 9A:
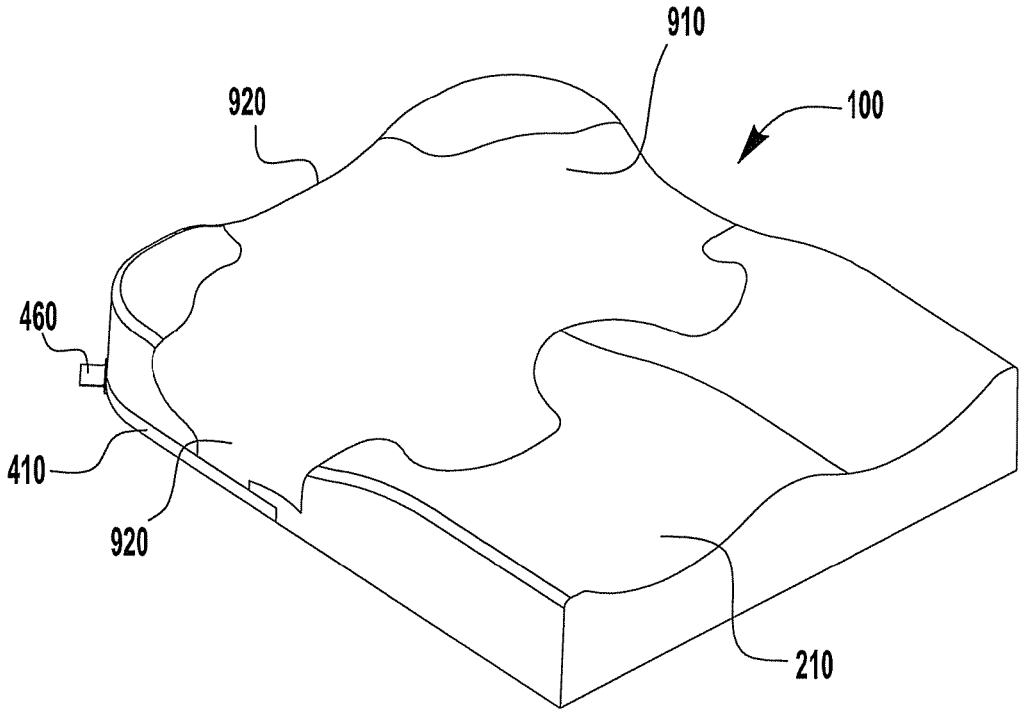
FIG. 9A is a top perspective view of the seat cushion assembly of FIG. 1 with an optional overlay pad.
Figure 9B:
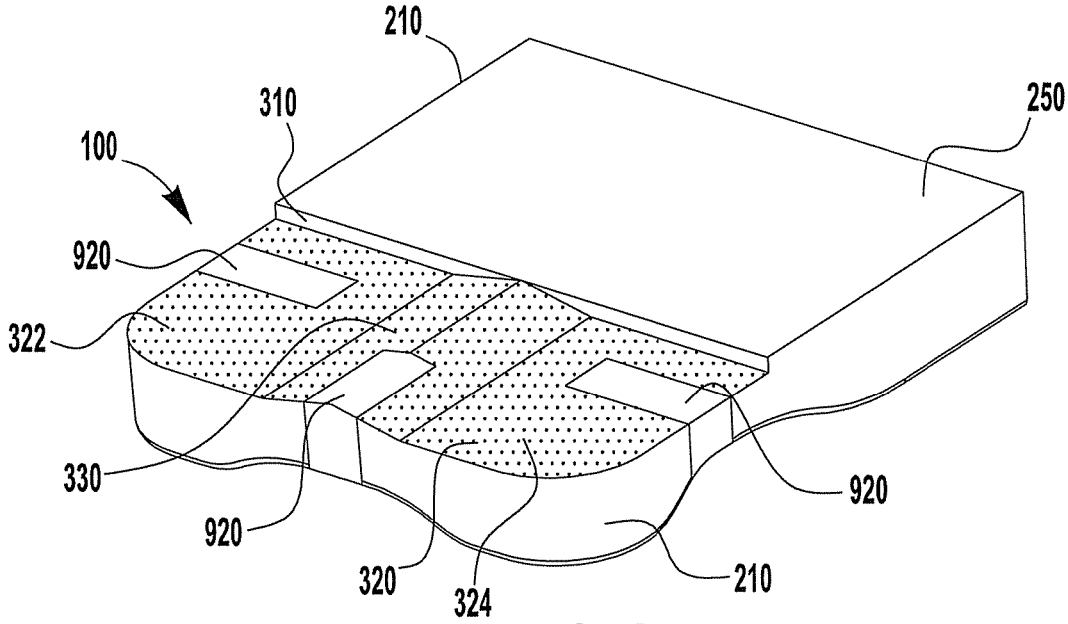
FIG. 9B is a bottom perspective view of the seat cushion assembly of FIG. 1 with an optional overlay pad.

Referring to FIGS. 9A and 9B, the seat cushion assembly 100 includes an optional overlay pad 910. The overlay pad 910 provides additional cushioning for the user. The overlay pad 910 may be made from a variety of suitable materials. The illustrated overlay pad 910 is filled with gel; however, additional embodiments of the overlay pad 910 do not have a gel filling. The overlay pad 910 is fastened to the base cushion 210 by a plurality of fastening straps 920 which adhere to the attachment element 324 of the recess 240 (as shown in FIG. 9B). The overlay pad 910 can also fastened to the base cushion 210 by A hook and loop type fastener, buttons, tape, adhesive, glue, or any other suitable fastener.

The seat cushion assembly 100 disclosed by this detailed description can be used with any type of wheelchair or mobility aid, including but not limited to, manually driven wheelchairs, motor driven wheelchairs, wheelchairs with rigid frames, wheelchairs with folding frames, scooters, rollators, and other mobility aids. In addition, the seat cushion assembly 100 disclosed by this detailed description can also be used for other devices apart from wheelchairs or mobility aids. For example, the seat cushion assembly 100 could serve as a standalone cushion for use in sitting on any surface.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

The components of the seating assembly, including the inserts, may have a variety of different shapes, dimensions, configurations and constructions in various additional embodiments. The shape, dimension, configuration and construction of the components of the seating assembly may be changed based upon design, appearance or ornamentality and are not limited to the shape, dimension, configuration and construction disclosed herein.

Having thus described the many embodiments, the invention is now claimed to be:

1. A seat cushion assembly, comprising:

a base cushion, wherein the base cushion has a generally flat bottom surface, and wherein a recess is defined within the bottom surface, the recess comprising an attachment element;

at least two inserts, wherein each of the at least two inserts have a generally flat bottom surface, wherein the at least two inserts are adapted to be housed within the recess of the base cushion under opposing sides of the base cushion, and wherein the at least two inserts comprise a fastener for affixing the at least two inserts to the attachment element of the recess;

wherein the flat bottom surface of the base cushion and the flat bottom surfaces of the at least two inserts combine to form a single generally flat surface when the at least two inserts are housed within the recess; and wherein either of the at least two inserts may be selectively removed from the recess of the base cushion to selectively lower the side of the base cushion that housed the removed insert when a user is seated within the seat cushion assembly.

2. The seat cushion assembly of claim 1, wherein the attachment element of the recess comprises a hook and loop fastener adherent fabric.

3. The seat cushion assembly of claim 1, wherein the at least two inserts are adapted to be selectively attached to one another, whereby one of the at least two inserts may be housed within the recess and the other of the at least two inserts may be selectively attached to the housed insert so that both of the at least two inserts are retained within the recess under the same side of the base cushion.

4. The seat cushion assembly of claim 3, wherein the fastener of the at least two inserts comprises a hook and loop fastener strap that encircles the insert.

5. The seat cushion assembly of claim 4, wherein the fastener of one of the at least two inserts comprises a hook material and the fastener of the other of the at least two inserts comprises a loop material.

6. The seat cushion assembly of claim 3, wherein when the at least two inserts are attached to one another and the user is seated within the seat cushion assembly, an angled portion of at least one of the inserts deflects downward.

7. The seat cushion assembly of claim 1, wherein the base cushion has a length and a width and wherein the recess spans generally the entire width and approximately half of the length.

8. The seat cushion assembly of claim 1, wherein the at least two inserts have a generally flat upper surface parallel to the bottom surface and at least one inclined surface.

9. The seat cushion assembly of claim 8, wherein the at least two inserts have a thickness of approximately less than or equal to 1 inch.

10. The seat cushion assembly of claim 1, further comprising a moisture resistant outer cover adapted to enclose the base cushion and the inserts.

11. The seat cushion assembly of claim 1, wherein the seat cushion assembly is configured to permit adjustment of the base cushion relative to the sagittal plane of the user seated within the seat cushion assembly.

12. The seat cushion assembly of claim 1, wherein the base cushion is configured to conform to the contour of a surface supporting the seat cushion assembly when the user is seated within the seat cushion assembly and one or more of the at least two inserts is removed.

13. The seat cushion assembly of claim 1, wherein the at least two inserts are configured to be selectively removed from the recess of the base cushion without removal of the base cushion from the seat cushion assembly.

14. The seat cushion assembly of claim 1, wherein when either of the at least two inserts are removed from the recess of the base cushion, the side of the base cushion that housed the removed insert is lowered relative to the opposing side of the base cushion such that a seating surface of the base cushion is uneven and the pelvis of the user seated within the seat cushion assembly is lowered on one side relative to the other.

15. A seat cushion assembly, comprising:

a base cushion;

a recess defined within a bottom surface of the base cushion, the recess comprising a first insert receiving portion, second insert receiving portion and a projection located between the first and second insert receiving portions, the projection comprising first and second inclined surface;

at least a first and second insert, wherein each of the first and second inserts comprise at least one incline surface, wherein the first and second inserts are adapted to be housed within the recess of the base cushion under opposing sides of the base cushion, and wherein the inclined surface of the first insert abuts the first inclined surface of the projection and the inclined surface of the second insert abuts the second inclined surface of the projection; and wherein either of the first or second inserts may be selectively removed from the recess of the base cushion to selectively lower the side of the base cushion that housed the removed insert when a user is seated within the seat cushion assembly.

16. The seat cushion assembly of claim 15, wherein the recess comprises an attachment element and wherein the first and second inserts comprise a fastener for affixing the at first and second inserts to the attachment element of the recess.

17. The seat cushion assembly of claim 16, wherein the attachment element of the recess comprises a hook and loop fastener adherent fabric.

18. The seat cushion assembly of claim 16, wherein the first and second inserts are adapted to be selectively attached to one another, whereby one of the first and second inserts may be housed within the recess and the other of the first and second inserts may be selectively attached to the housed insert so that both of the first and second inserts are retained within the recess under the same side of the base cushion.

19. The seat cushion assembly of claim 18, wherein the fastener of the at first and second inserts comprises a hook and loop fastener strap that encircles the insert.

20. The seat cushion assembly of claim 19, wherein the fastener of one of the first and second inserts comprises a hook material and the fastener of the other of the at first and second inserts comprises a loop material.

21. The seat cushion assembly of claim 15, wherein the base cushion has a length and a width and wherein the recess spans generally the entire width and approximately half of the length.

22. The seat cushion assembly of claim 15, wherein the first and second inserts have a thickness of approximately less than or equal to 1 inch.

23. The seat cushion assembly of claim 15, further comprising a moisture resistant outer cover adapted to enclose the base cushion and the inserts.

24. A seat cushion assembly, comprising:

a base cushion, wherein the base cushion has a generally flat bottom surface, a recess defined within the bottom surface of the base cushion, the recess comprising an attachment element, at least a first and second insert receiving portion, and a projection located between the first and second insert receiving portions, the projection comprising a first and second inclined surface;

wherein each of the first and second inserts have a generally flat bottom surface and at least one inclined surface, wherein the first and second inserts are adapted to be housed within the recess of the base cushion under opposing sides of the base cushion, wherein the first and second inserts comprise a fastener for affixing the first and second inserts to the attachment element of the recess, and wherein the inclined surface of the first insert abuts the first inclined surface of the projection and the inclined surface of the second insert abuts the second inclined surface of the projection; and wherein the flat bottom surface of the base cushion and the flat bottom surfaces of the first and second inserts combine to form a single generally flat surface when the first and second inserts are housed within the recess; and wherein either of the first or second inserts may be selectively removed from the recess of the base cushion to selectively lower the side of the base cushion that housed the removed insert when a user is seated within the seat cushion assembly.

25. The seat cushion assembly of claim 24, wherein the first and second inserts are adapted to be selectively attached to one another, whereby one of the first and second inserts may be housed within the recess and the other of the first and second inserts may be selectively attached to the housed insert so that both of the first and second inserts are retained within the recess under the same side of the base cushion.

26. A seat cushion assembly, comprising:

a base cushion comprising a bottom surface and a recess defined within the bottom surface, the recess comprising an attachment element;

at least two inserts, wherein each of the at least two inserts are configured to be housed within the recess of the base cushion, and wherein the at least two inserts comprise a fastener for affixing the at least two inserts to the attachment element of the recess; and wherein either of the at least two inserts may be selectively removed from the recess of the base cushion to selectively lower the side of the base cushion that housed the removed insert when a user is seated within the seat cushion assembly;

wherein the base cushion is configured to conform to the contour of a surface supporting the seat cushion assembly when the user is seated within the seat cushion assembly and one or more of the at least two inserts is removed; and wherein the seat cushion assembly is configured to permit adjustment of the base cushion relative to the sagittal plane of the user seated within the seat cushion assembly.

* * * * *